US005960831A

United States Patent [19]

Borcea et al.

[11] Patent Number: 5,960,831

[45] **Date of Patent: *Oct. 5, 1999**

[54] ELECTROMECHANICAL SERVOVALVE

[75] Inventors: Nicky Borcea, Weston; Alexandru D. Ionescu, Easton, both of Conn.

[73] Assignee: Robohand, Inc., Monroe, Conn.

[ * ] Notice: This patent is subject to a terminal disclaimer.

[21] Appl. No.: 08/057,898

[22] Filed: May 7, 1993

[51] Int. Cl.[6] ..... F15B 13/044

[52] U.S. Cl. ..... 137/625.65; 251/905

[58] Field of Search ..... 137/625.65; 251/905

[56] References Cited

U.S. PATENT DOCUMENTS

| | | | |
|---|---|---|---|
| 3,099,280 | 7/1963 | Holzbock | 137/625.65 X |
| 3,466,003 | 9/1969 | Boonshaft et al. | 137/628.65 X |
| 3,807,441 | 4/1974 | Grosseau | 137/625.65 X |
| 3,840,045 | 10/1974 | Grosseau | 137/625.65 X |
| 4,040,445 | 8/1977 | McCormick . | |
| 4,544,129 | 10/1985 | Ichiryu et al. | 137/625.65 X |
| 4,648,580 | 3/1987 | Kuwano et al. | 137/625.65 X |
| 5,012,722 | 5/1991 | McCormick | 137/625.65 X |
| 5,076,537 | 12/1991 | Mears, Jr. . | |
| 5,460,201 | 10/1995 | Borcea et al. | 137/625.65 |

FOREIGN PATENT DOCUMENTS

| | | | |
|---|---|---|---|
| 56-167906 | 12/1981 | Japan | 137/625.65 |
| 57-1807 | 1/1982 | Japan | 137/625.65 |
| 58-166183 | 10/1983 | Japan | 137/625.65 |
| 62-83572 | 4/1987 | Japan | 137/625.65 |
| 196517 | 6/1965 | Sweden | 137/625.65 |

*Primary Examiner*—Gerald A. Michalsky
*Attorney, Agent, or Firm*—Fattibene & Fattibene; Paul A. Fattibene; Arthur T. Fattibene

[57] ABSTRACT

This disclosure is directed to an electromechanical servovalve having an electrical coil or winding movably mounted relative to a magnet so that when the winding is energized by an electric current, it interacts with the magnetic flux generated by the magnet to shift a valve member of an associated valve between operative and inoperative position. The arrangement is such that the valve member functions as the bearing for the movable coil or winding so as to render the servovalve lighter and faster in operation. The valve member is biased toward its neutral or inoperative position by a pair of opposed springs, one of which can be readily adjusted to vary the biasing force of the springs acting upon the valving member.

1 Claim, 3 Drawing Sheets

ELECTROMECHANICAL SERVOVALVE

FIELD OF INVENTION

This invention is directed to an electromechanical servovalve for controlling the operation of an associated fluid control valve.

PRIOR ART

Heretofore, electromechanical servovalves of the type disclosed in U.S. Pat. Nos. 4,040,445 and 5,076,537 incorporated a movable coil and associated header relative to a magnetic source to control the operation of a valve member wherein the movable coil and associated header required a bearing support on either side thereof. It has been noted that this bearing support, as commonly used in such servovalves, renders the unit bulky and heavy which tends to retard the speed of the valve. U.S. Pat. No. 3,099,280 illustrates the use of movable coil or winding operating a hydraulic servovalve. As faster acting valves are desirable, a need for a faster acting valve is paramount.

OBJECT

An object of this invention is to provide a novel bearing arrangement for the moving coil or winding to create a lighter and faster acting electromechanical servovalve free of any lateral forces acting on the movable coil or winding with an arrangement whereby the servovalve can be readily adjusted to insure the maintenance of the servovalve in its neutral position when the electromechanical servovalve is de-energized for any reason.

SUMMARY OF THE INVENTION

The foregoing objects and other features and advantages are attained by an improved electromechanical servovalve having a coil housing connected to an axially aligned valve body having a reciprocating slidably mounted spool valve member to control the flow of operating fluid through the valve. The actuation of the spool valve member is effected by the interaction of an electrical coil or winding movably mounted relative to a magnetic flux generated by a permanent magnet. According to this invention, the stem of the spool valve member is rigidly connected to the movable coil or winding so that when the coil or winding is energized by an electric current, the coil or winding is displaced to shift the spool valve relative to the inlet and outlets of the valve assembly to control the flow of operating fluid therethrough accordingly. The arrangement is such that the valve member functions as a bearing for the movable coil or winding. In accordance with this invention, the valve member is maintained under a spring bias to assure that the valve member is maintained in a neutral inoperative position whenever the coil or winding is de-energized. In one form of the invention, counterbalancing coil springs are disposed at each end of the valve member to impart a counteracting bias directly on the ends of the valve member. An adjusting screw is operatively associated with one of the coil springs to adjust the spring bias action on the valve member as may be necessary to maintain the neutral position in the inoperative position of the valve. In another form of the invention, one of the coil springs is interposed between the magnet and the movable coil or winding and in alignment with the valve member.

IN THE DRAWINGS

DETAIL DESCRIPTION

Figure 1:
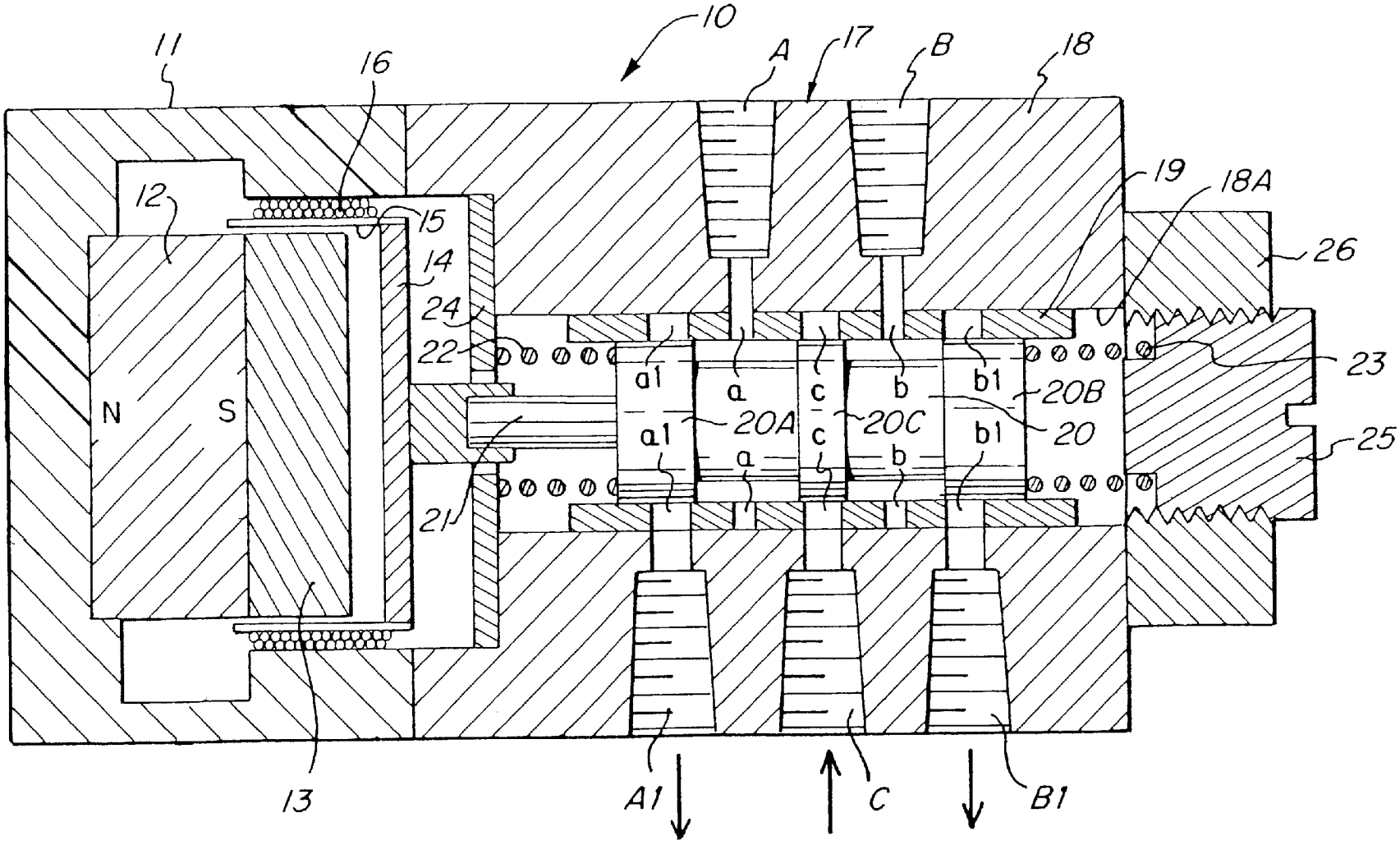
FIG. 1 illustrates a cross-sectional view of an electromechanical servovalve embodying the invention with the valving member illustrated in a neutral inoperative position.
Figure 2:
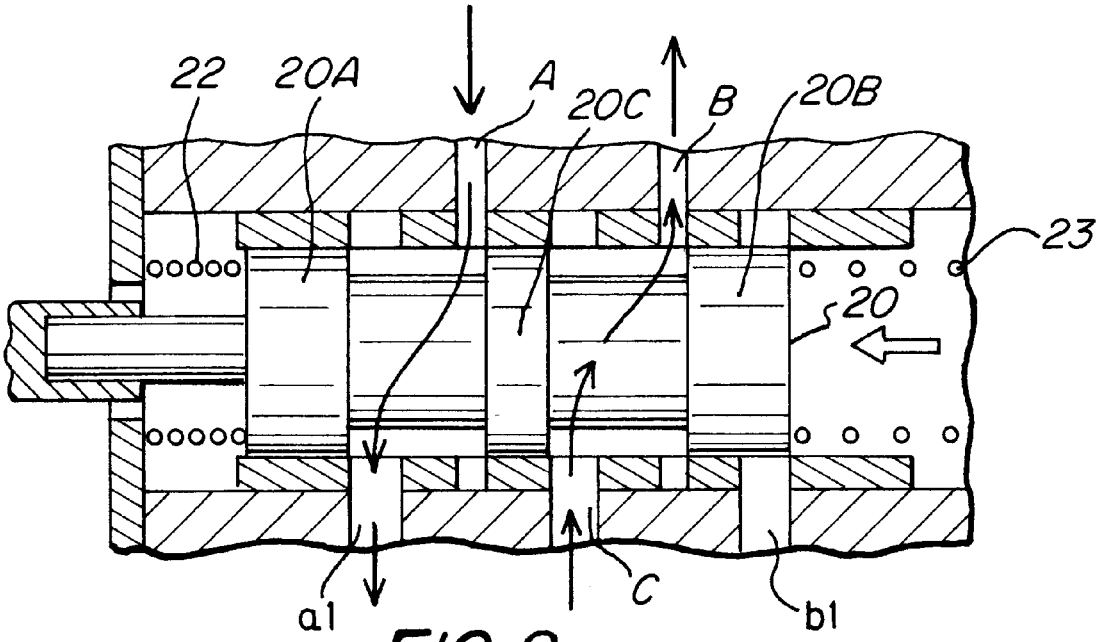
FIG. 2 illustrates a fragmentary sectional view of FIG. 1 illustrating the valving member in a first operative position.
Figure 3:
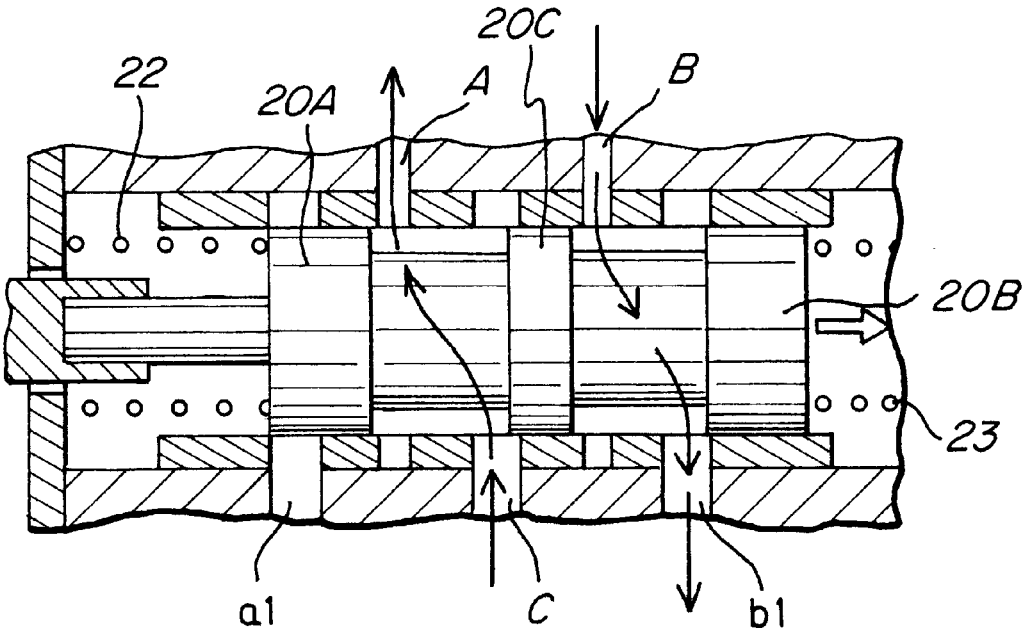
FIG. 3 illustrates a fragmentary section view of FIG. 1 illustrating the valving member in a second operative position.

Referring to FIGS. 1 to 3, there is shown an electromechanical servovalve 10 for controlling the operation of a particular machine or apparatus not shown. It will be understood that servovalve 10 is suitably connected to the machine or apparatus to be controlled thereby. As shown in FIG. 1, the electromechanical servovalve 10 comprises a coil housing 11 in which there is disposed a permanent magnet 12 and an associated pole piece 13 to generate a magnetic flux. Associated therewith is a movable header 14 and a connected core 15 about which an electric coil or windings 16 that is energized by an electric current. The arrangement is such that whenever the coil or windings 16 is energized by an electric current, it interacts with the magnetic flux generated by the magnet 12 to create an electromagnetic force to shift the header relative to the magnet 12.

Connected to the coil housing 11 is a servovalve assembly 17 which comprises a valve body 18 having fluid outlets A and B, and a fluid inlet C. It will be understood that the fluid inlet C is connected to a suitable source of operating fluid, e.g. a source for compressed air or hydraulic fluid, and the respective outlets A and B to suitable operating mechanism to be controlled by the valve assembly, e.g., an operating piston and cylinder (not shown). The valve body may also be provided with exhaust outlets A1 and B1 for the cylinders associated with outlets A and B respectively.

The valve body 18 is provided with a through bore 18A disposed in axial alignment with the movable header 14. Disposed within the bore 18A is a valve sleeve 19 which is provided with a plurality of circumferentially spaced ports a, b, c, a1 and b1 arranged to be disposed in communication with the outlets A and B, inlet C and exhaust outlets A1 and B1 respectively. Slidably disposed within the valve sleeve 19 is a spool valve member 20 having spaced valve heads 20A, 20B and 20C for valving the inlet C and exhaust outlets a1 and b1 as the valve member 20 is shifted accordingly; as will be hereinafter described.

One end of the valve member 20 has connected thereto a valve stem 21 which rigidly connects the valve spool member 20 to the movable header 14.

As best seen in FIG. 1, the valve member 20 is spring biased in its neutral or inoperative position. In the embodiment of FIG. 1, this is attained by a pair of coil springs 22 and 23 exerting a spring bias on the opposed ends of the valve spool member 20. As shown, the coil spring 22 circumscribes the valve stem 21 and is disposed between a stop 24 and the end of valve head 20A. Spring 23, exerting a counterbalancing bias on the valve member 20, is disposed between the other end of the valve member or valve head 20B and an adjusting screw 25 which is threaded to an adaptor 26 connected to the end of the valve body in alignment with the axis of the valve body 17. By turning the adjusting screw in one direction or the other, it will be noted that the bias exerted by the springs can be adjusted so as to insure the maintenance of the valve member in its neutral position as shown in FIG. 1 when the coil or windings 16 are de-energized. In the embodiment described, it will be apparent that the bearing for the movable header 14 comprises the valve heads 20 A, B and C of valve member 20 and which comprises the sole bearing for the header 14 and associated movable coil. In accordance with this invention, the spool valve member functions both as a valving member and a bearing for the movable header, which construction makes the overall assembly lighter and faster in operation.

In operation, it will be noted that when the coil or winding 16 is energized to shift the valve member 20 to the left as seen in FIG. 2, the respective spool heads 20 A, B and C are shifted to the left whereby the inlet C is placed in communication with outlet B to actuate the mechanism or cylinder connected to outlet B while outlet A is disposed in communication with exhaust part a1 for deactivating the cylinder or mechanism connected to outlet A. When the spool valve member 20 is shifted to the right of neutral as shown in FIG. 3, the operation is reversed, i.e. the inlet C is placed in communication with outlet A, whereas the outlet B is connected to exhaust b1 to deactivate the mechanism or cylinder connected to outlet B. In the event that the coil or winding 16 is de-energized for any reason, the springs 22, 23 will bias the spool valve member toward its neutral or inoperative position wherein the spool head 20C seals off the inlet C, as shown in FIG. 1.

Figure 4:
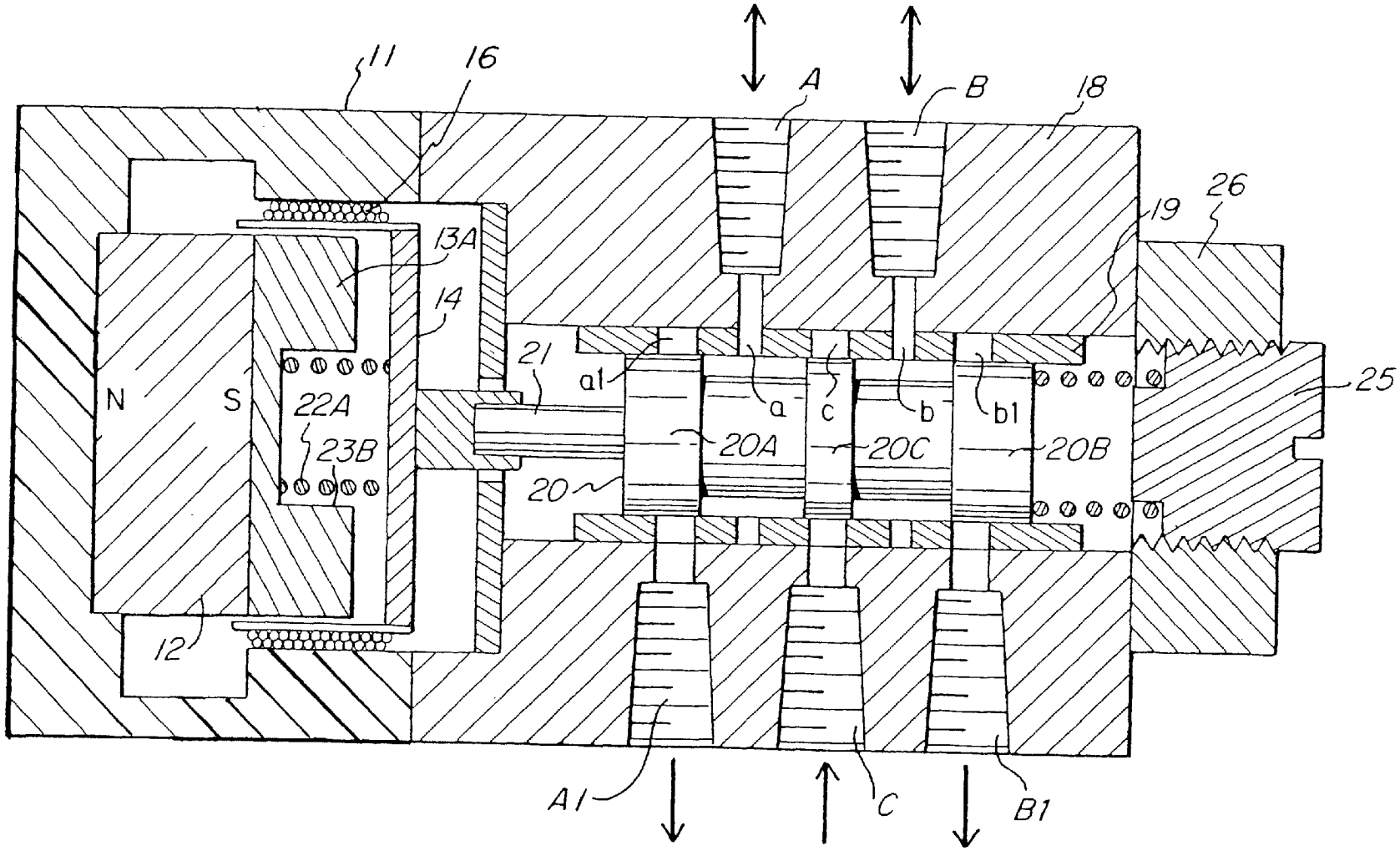
FIG. 4 is a longitudinal sectional view of a slightly modified embodiment of the invention.

The embodiment of FIG. 4 is identical with that described with respect to FIG. 1 with the exception that one of the springs 22A has been relocated. As shown in FIG. 4, spring 22A is disposed between the pole magnet 13A and the movable header 14 whereby the spring 22A acts directly on the header 14 and indirectly on the valve member 20. To provide for the spring 22A, the pole magnet 13A may be provided with a seat 13B for receiving the spring 22A. In all other respects, the operation and construction of the electromechanical valve of FIG. 4 is identical to that described with respect to FIGS. 1 to 3.

While the invention has been described with respect to the illustrated embodiments, it will be understood and appreciated that variations and modifications may be made without departing from the spirit or scope of the invention.

What is claimed is:

1. An electromagnetic servovalve comprising:

a valve body and a connected coil housing, said coil housing having a back wall and a connected circumscribing end wall, said end wall terminating in a circumscribing thickened portion having a longitudinal thickness greater than said back wall and connected end wall, a recessed seat formed in said back wall, a stop having an opening therein interposed between said valve body and connected coil housing, a magnet means retained in said recessed seat and centrally disposed within said coil housing, said magnet means being spaced from said circumscribing end wall of said coil housing and axially disposed therein, a movable header mounted for movement relative to said magnet means, said movable header including a cylinder defining a core disposed about said magnet means within the space defined between said circumscribing end wall of said coil housing and said magnet means, an electrical winding coiled about said cylindrical core, said valve body having a fluid inlet and a fluid outlet, a valve means including a valve member having a plurality of longitudinally spaced apart valve heads disposed within said valve body for valving said fluid inlet and outlet, and a valve stem extending through said stop opening rigidly connecting said valve member to said header whereby said valve member defines the bearing for said movable header, spring means biasing said valve member toward a neutral position in the de-energized state of said electrical winding, said spring means comprising a first and second coil spring disposed at opposite ends of said valve member normally biasing said valve member toward a neutral inoperative position, said first coil spring being disposed so as to circumscribe said valve stem at one end thereof and said first coil spring being biased between said stop and directly bearing on the adjacent endmost valve head, and an adjusting screw, said second coil spring being biased between said adjusting screw and directly bearing on the other endmost valve head adjacent said adjusting screw, so that by adjusting said adjusting screw the bias exerted by said coil springs can be adjusted, and said opposed coil springs impart axial stability to said valve means and connected header.

* * * * *